US008087188B2

(12) United States Patent
Labbe

(10) Patent No.: US 8,087,188 B2
(45) Date of Patent: Jan. 3, 2012

(54) WEIGHT-ACTIVATED TYING SHOE

(76) Inventor: Frederick Labbe, St-Hubert (CA)

( * ) Notice: Subject to any disclaimer, the term of this patent is extended or adjusted under 35 U.S.C. 154(b) by 1114 days.

(21) Appl. No.: 11/872,695

(22) Filed: Oct. 15, 2007

(65) Prior Publication Data

US 2008/0086911 A1 Apr. 17, 2008

Related U.S. Application Data

(60) Provisional application No. 60/829,541, filed on Oct. 15, 2006.

(51) Int. Cl.
*A43C 11/00* (2006.01)
*A43C 1/00* (2006.01)

(52) U.S. Cl. ..... 36/50.1; 24/712

(58) Field of Classification Search ..... 36/50.1, 36/50.5; 24/712, 712.1, 713, 713.2
See application file for complete search history.

(56) References Cited

U.S. PATENT DOCUMENTS

| | | | | |
|---|---|---|---|---|
| 5,983,530 | A * | 11/1999 | Chou | 36/50.1 |
| 6,427,361 | B1 * | 8/2002 | Chou | 36/50.1 |
| 6,467,194 | B1 * | 10/2002 | Johnson | 36/50.1 |
| 6,643,954 | B2 * | 11/2003 | Voswinkel | 36/50.1 |
| 7,096,559 | B2 * | 8/2006 | Johnson | 29/433 |
| 7,661,205 | B2 * | 2/2010 | Johnson | 36/50.1 |
| 2005/0198867 | A1 * | 9/2005 | Labbe | 36/50.1 |

* cited by examiner

*Primary Examiner* — Jila Mohandesi
*Assistant Examiner* — Sharon M Prange
(74) *Attorney, Agent, or Firm* — Rothwell, Figg, Ernst & Manbeck, P.C.

(57) ABSTRACT

A weight-activated tying shoe wherein user who, upon sliding his foot inside the shoe, will depress a movable inner sole. This activates a side mechanism composed of a winch with a cable system used to close the tongue of the shoe towards the user's foot, thus lacing the shoe. The user simply uses his weight to activate the mechanism. Using his other foot, the user can move a pedal to release the mechanism's tension. Most of the mechanical components are located on both sides of the shoe body.

7 Claims, 7 Drawing Sheets

WEIGHT-ACTIVATED TYING SHOE

CROSS-REFERENCE TO RELATED APPLICATIONS

Figure 1:
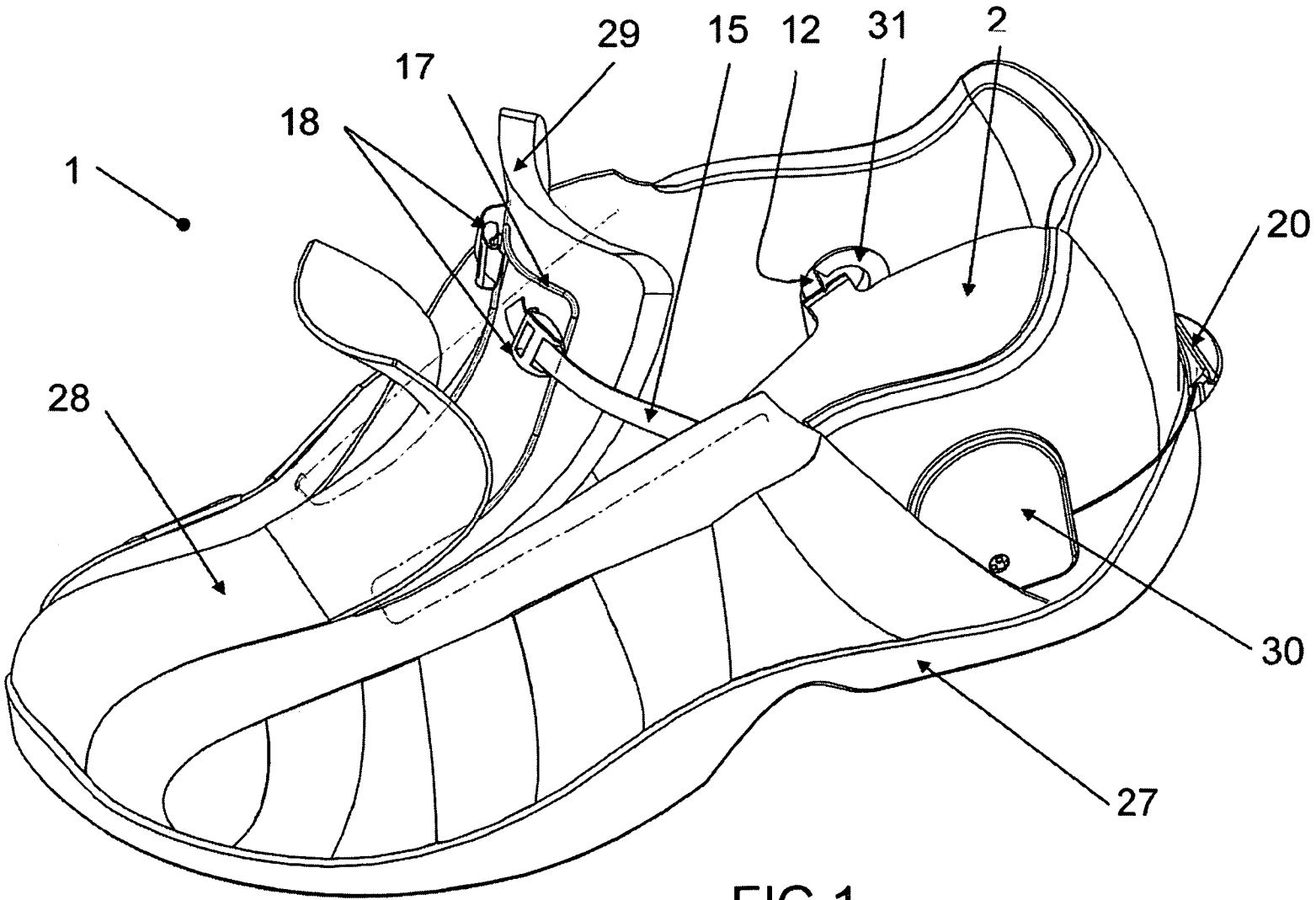

This application claims the benefit of provisional patent application Ser. No. 60/829,541, filed Oct. 15, 2006 by the present inventor.

BACKGROUND

1. Field of the Invention

The invention relates generally to footwear, but more particularly to a weight-activated system intended to tie shoes, boots and snow shoes.

2. Prior Art

Lacing shoes can be difficult or impossible for some people, and several inventors have tried over the years to simplify the matter.

U.S. Pat. No. 11,078,986 by the present inventor shows a self tying shoe on which the lacing device is activated by the weight of the user. The weight is transmitted to a mechanism located within the sole, underneath the foot. The large number of moving parts makes the mechanism vulnerable to breakage. In addition, the underneath location of the mechanism causes some discomfort to the foot. For these reasons, this patent has been abandoned.

U.S. Pat. No. 4,741,115 shows a ski boot with an operating assembly for closing and adjustment, and comprises a power source supported by the ski boot which operates a driving gearwheel which is selectively engageable with driven gearwheels for the winding of cables of closing and/or adjustment devices of the boot.

U.S. Pat. No. 5,205,055 shows a shoe member including a plurality of securement webs directed about a lacing gap within the shoe upper, wherein the webs are each mounted slidably within associated cavities, with tether lines mounted to the webs operative above a crank pulley, with the crank pulley in operative engagement with a slidable actuator rod to effect projection of the securement webs forcibly within each respective cavity, wherein a gas cylinder is operative to effect rotation of the crank pulley by use of an associated slide rod within a guide cylinder to effect winding of each associated tether line relative to each associated securement web.

U.S. Pat. No. 5,335,401 shows a device for quickly tightening shoelaces on a shoe and for locking the tightened laces without the need for tying a bow or other knot. The device includes a body unit with a slotted opening formed with a chamfered edge along one ide of the slot. A rotatable shaft which includes a set of chamfered ridges rolls laterally across the width of the slot. A shoelace introduced through the slot becomes pinched between the chamfered edge of the slotted opening and the chamfered ridges of the shaft. The shaft is spring biased to automatically lock the laces in place upon being tightened to the desired tension. A quick release lever retracts the shaft to unpinch the lace.

U.S. Pat. No. 5,511,325 shows a shoe having a central rotary closure arranged on the heel of the upper in the area above the location at which the heel bone is received and having at least one tightening element which has a tightening section running from the central rotary closure towards each side of the shoe. The tightening sections are coupled by a coupling element with at least one strap which runs from each tightening section or coupling element over the instep and/or by the arch to the other tightening section or coupling element.

U.S. Pat. No. 5,600,874 shows a central closing device for shoes with a rotationally supported cord disc for at least one cord-type tensioning member for closing the shoe in such a way that the number of rotations of the cord disc is limited without any increase in the space required. Both the cord disc and a stationary member each have mutually-cooperating tooth profiles having the same tooth pitch but of different diameters. Located in the intermediate space created due to the different diameters of the tooth profiles is an idling pinion of the same pitch, which meshes with the two tooth profiles. At least one stop is provided to limit the travel of the idling pinion.

U.S. Pat. No. 5,718,021 shows a device for tying a shoelace on a shoe. The device includes a base and a cover hingedly mounted on the base so as to be pivotable between an open position and a closed position. The base includes a top surface, a bottom surface and first and second holes which are sized and shaped so that the shoelace can be inserted therethrough. The cover includes a top surface, a bottom surface and first and second pins which are aligned so as to project into the first and second holes, respectively, when the cover is in the closed position. The cover also includes a locking tab which engages with a tip on the base to releasably lock the cover in the closed position.

U.S. Pat. No. 5,839,210 shows a shoe incorporating adjustable straps that are positioned to tighten the shoe casing around a wearer's instep. A retractor mechanism incorporates elastic members. The elastic members are charged when the wearer loosens the shoe by pulling on the straps. The stored energy is released when a catch is disengaged and releases the elastic members to tighten and cinch the shoe on the wearer's foot.

U.S. Pat. No. 6,202,953 shows a footwear lacing system that includes a lace attached to a tightening mechanism. The lace is threaded through a series of opposing guide members positioned along the top of the foot and ankle portions of the footwear. The lace and guide preferably have low friction surfaces to facilitate sliding of the lace through the guide members so that the lace evenly distributes tension across the footwear member. The tightening mechanism allows incremental adjustment of the tension of the lace. A release mechanism allows a user to quickly loosen the lace.

U.S. Pat. No. 6,467,194 shows an automated tightening shoe with crisscrossed laces and a tightening mechanism which operates in one direction to cause automatic tightening of the crisscrossed laces to tighten the shoe about a wearer's foot, and which can be released easily so that the shoe can be removed from the wearer's foot.

Some inventions involve a manual tightening mechanism which is integrated into the outsole area while others use retractable heels latched on the shoe. Other systems uses a central closing device that requires manual winding. All these inventions need to be operated by hand. Another system involves the use of pneumatic means.

SUMMARY OF THE INVENTION

The present invention provides an efficient way to tie shoes using the weight of the user who, upon sliding his foot inside the shoe, will depress a movable inner sole. This activates a side mechanism composed of a winch with a cable system used to close the tongue of the shoe towards the user's foot, thus lacing the shoe. The user simply uses his weight to activate the mechanism. Using his other foot, the user can move a pedal to release the mechanism's tension.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIG. 1 Orthogonal view of the shoe unlaced, the side winch shown in a cut-out view, with the inner sole in an upward position.

Figure 2:
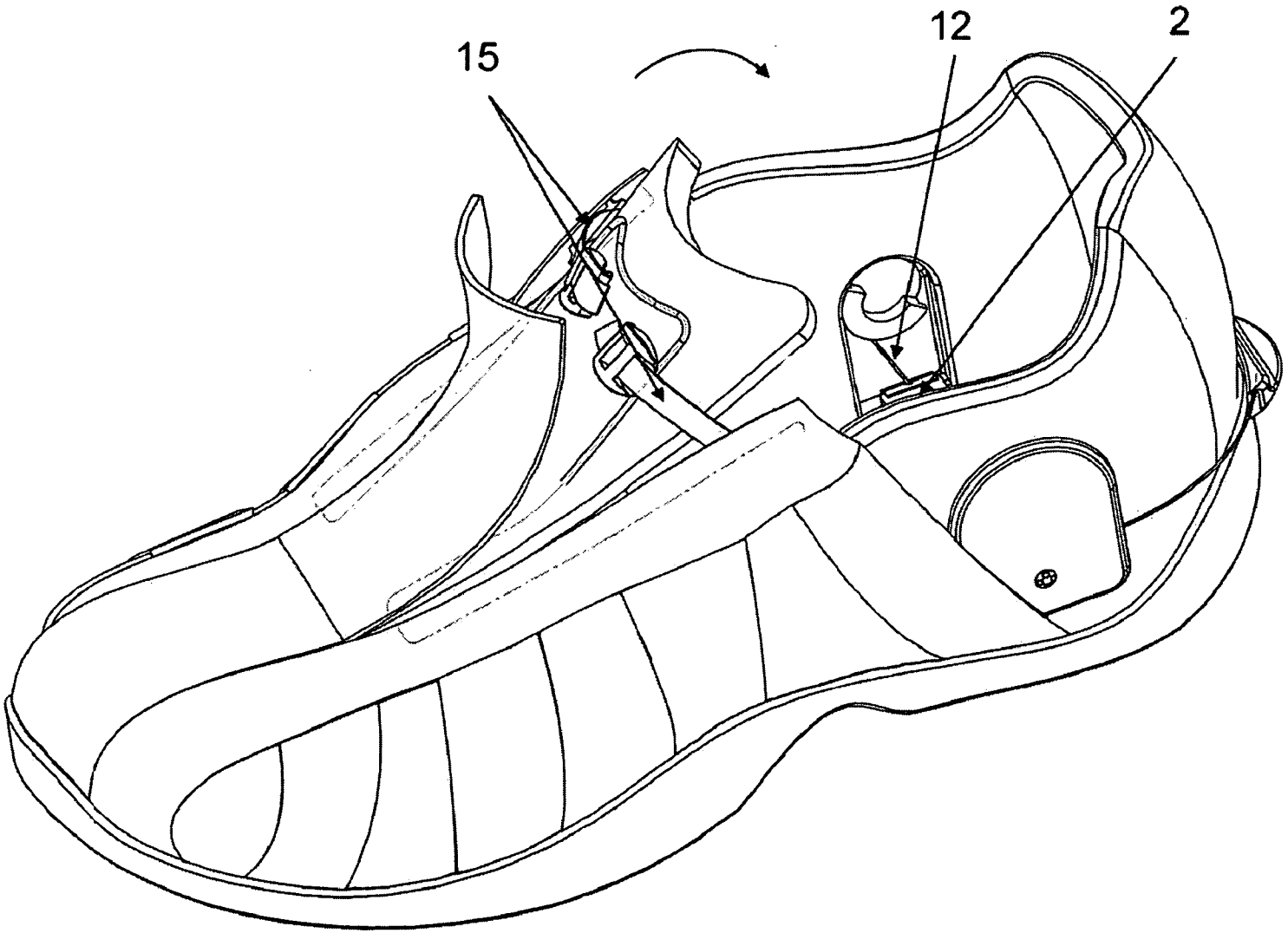

FIG. 2 Orthogonal view of the shoe laced, the side winch shown in a cut-out view, with the inner sole in a downward position.

Figure 3:
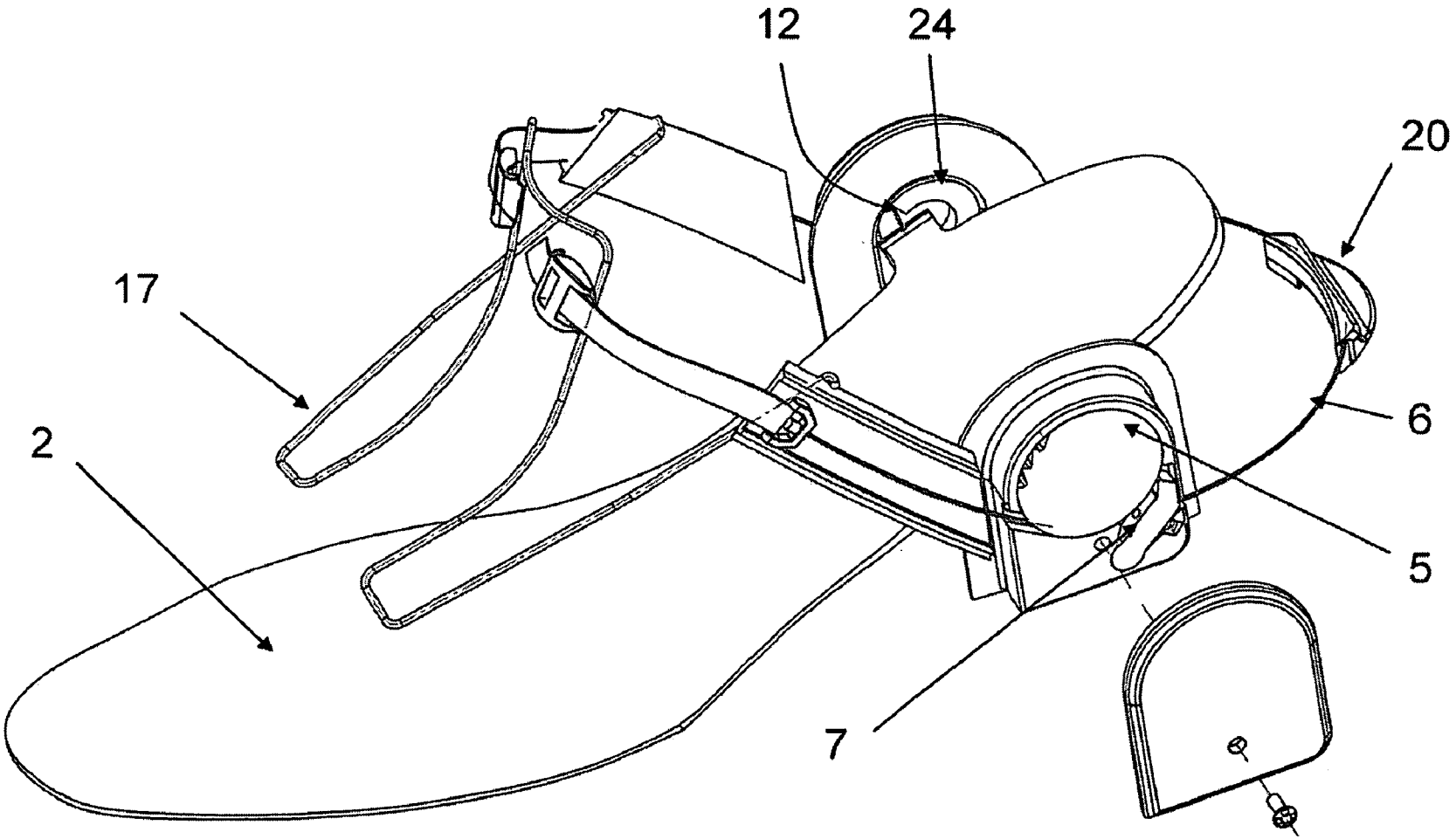

FIG. 3 Orthogonal view of the interior mechanism with the inner sole in an upward position.

Figure 4:
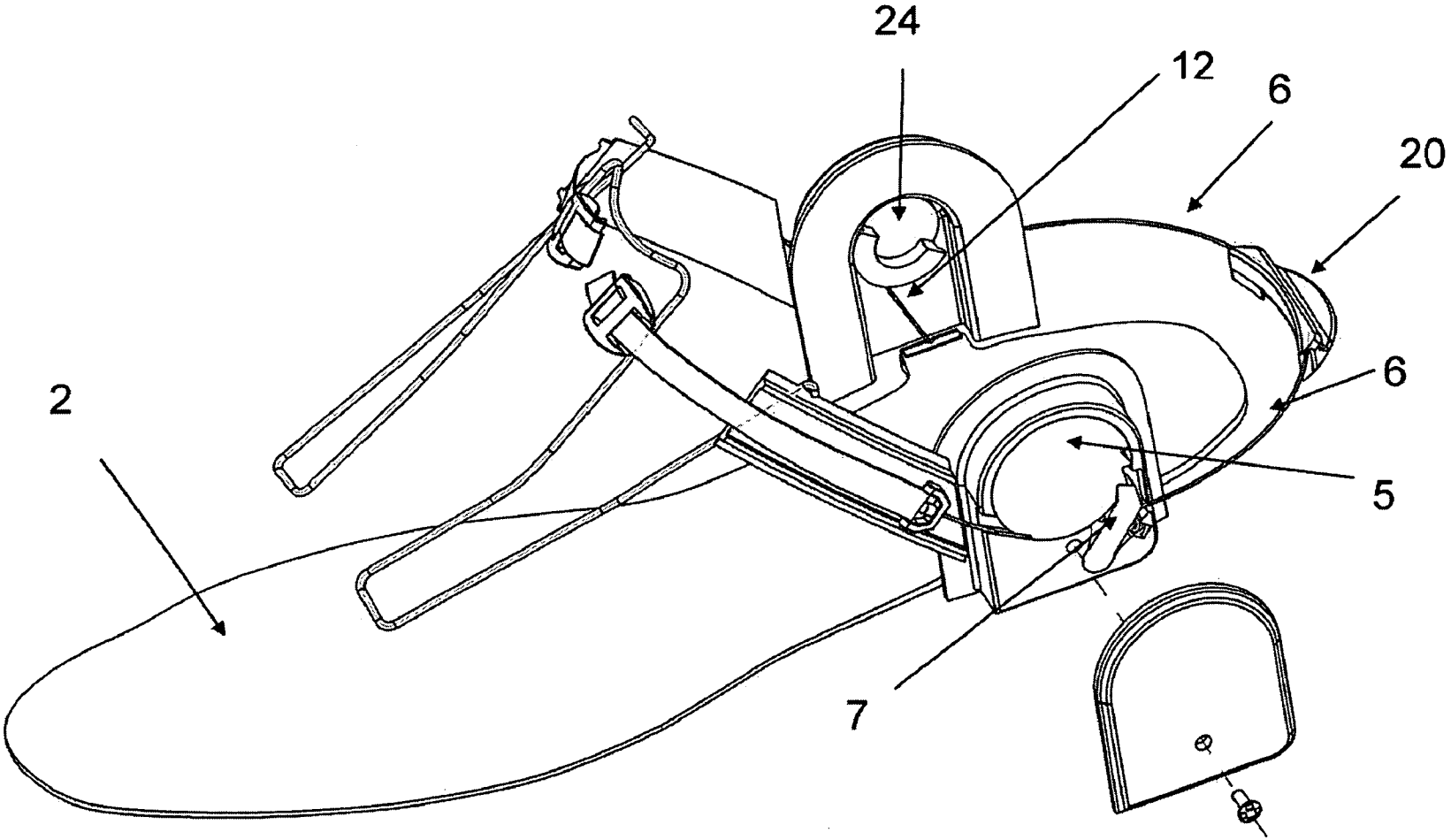

FIG. 4 Orthogonal view of the interior mechanism with the inner sole in a downward position.

Figure 5:
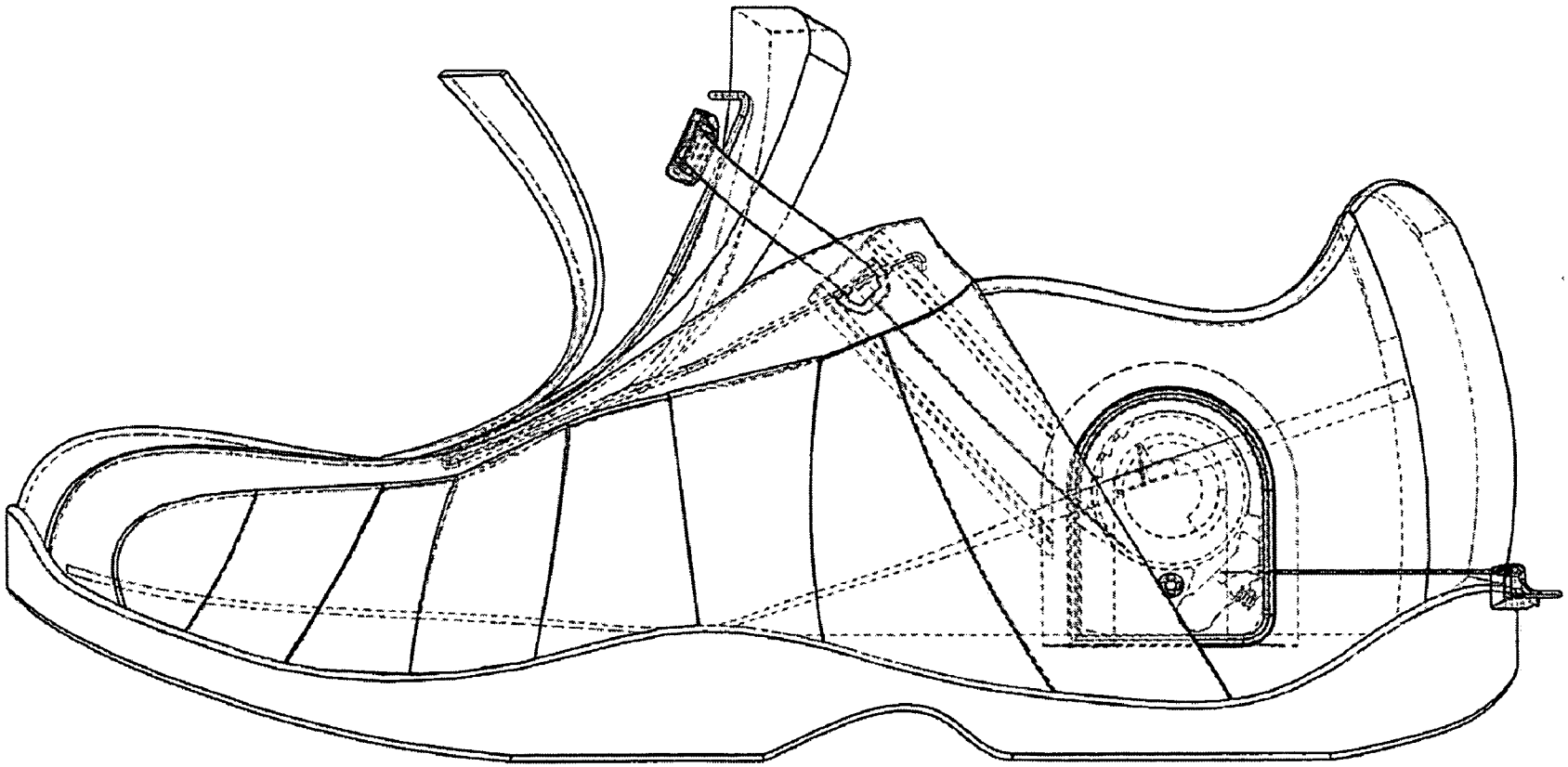

FIG. 5 See-through side view with the inner sole shown in both an upward and a downward position.

Figure 6:
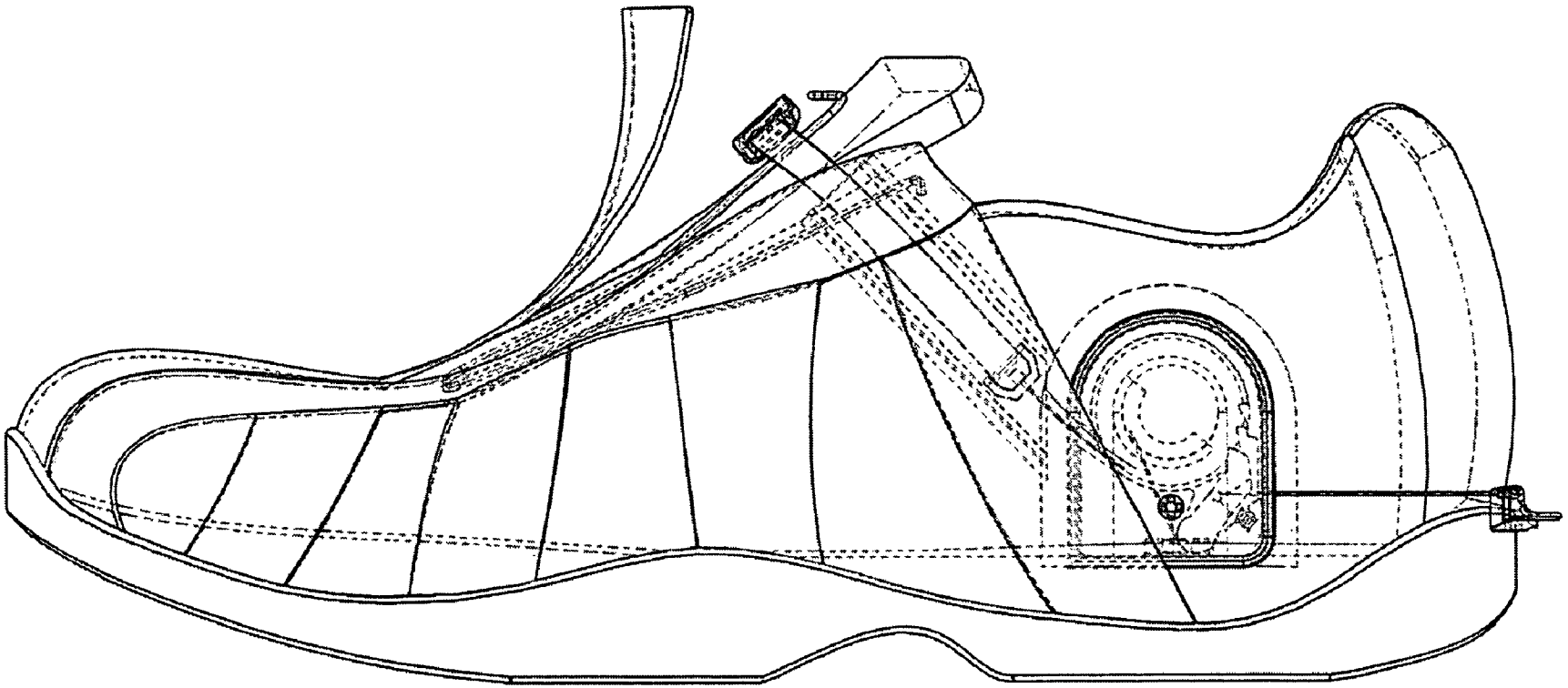

FIG. 6 See-through side view with the inner sole in a downward position.

Figure 7:
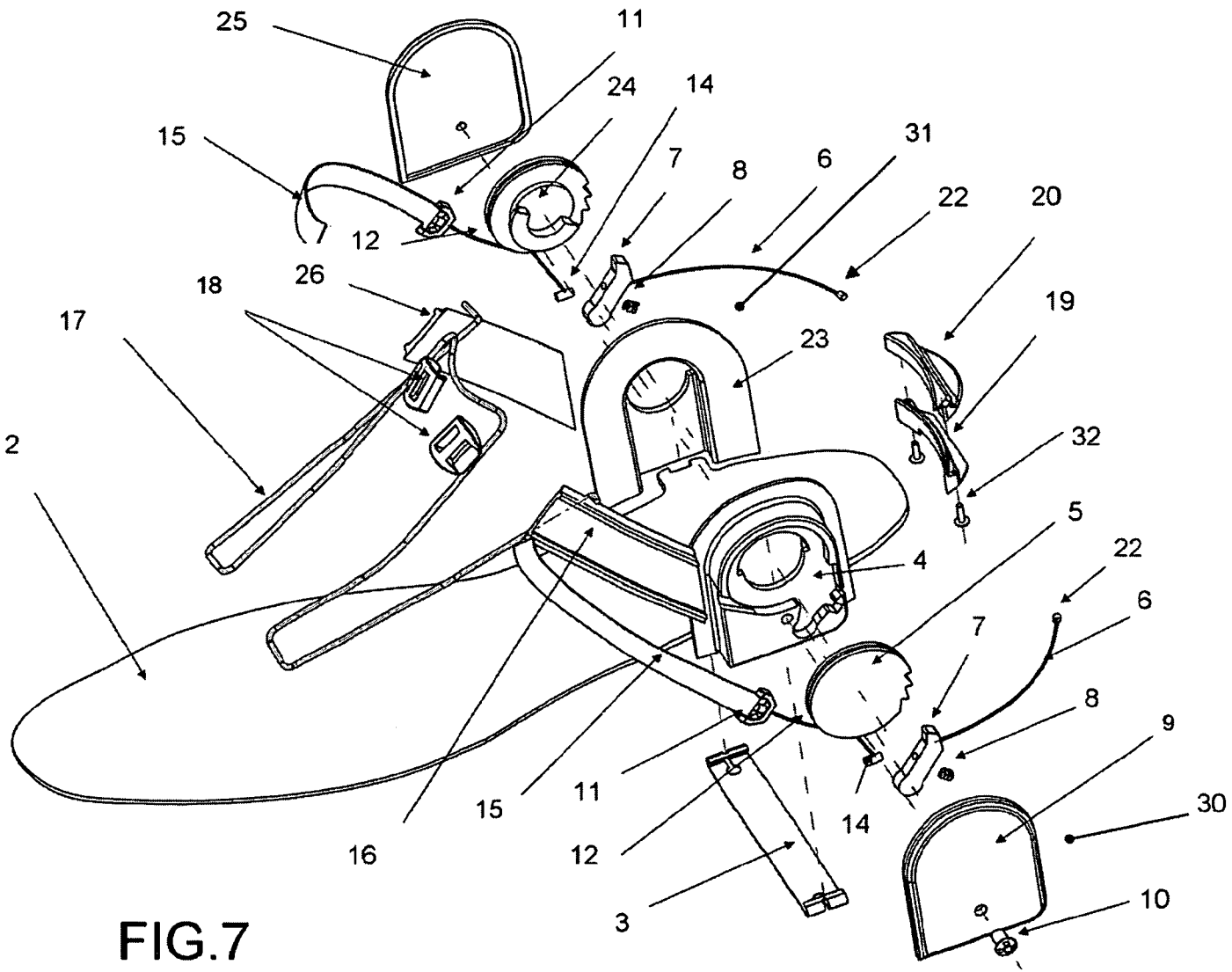

FIG. 7 Exploded view of the interior mechanism.

DETAILED DESCRIPTION OF THE PREFERRED EMBODIMENT

FIG. 1 A weight-activated lacing shoe (1) as illustrated in a conventional shoe having a sole (27), a body (28), including a tongue (29) and a holding rod (17), which acts as a guide and keeps the tongue open when the side winches (30-31) are released. The side winches (30-31) are connected to the inner sole (2) by cable (12), shown in the up position and a holding rod (17) integrated within a standard tongue typically found on a shoe, and two straps (15) preferably made of elastic material so as to prevent over-tensioning. The straps (15) pass through buckles (18) and allow the user to adjust tension. An untying pedal (20), located on the back of the outer sole, acts as a release switch, which disengages the tightening mechanism. The holding rod (17) is a biasing means normally in an outward configuration, as illustrated, and which pulls on the straps (15).

FIG. 2 When the inner sole (2) is in a downward position, the straps (15) are tied. The side winches (30-31) are connected to the inner sole (2) by cable (12), currently in the down position.

FIG. 3 The inner sole (2), currently in the up position, is connected with cables (12) to the ratchet wheel (24) which is symmetrically opposite another ratchet wheel (5). The ratchet pawl (7), currently in the release position, acts as a retainer to block the ratchet wheel (5) in the downward position. The ratchet pawls (7) are connected by a cable, strap or similar tension element (6) to the untying pedal (20).

FIG. 4 The inner sole (2), currently in the down position is connected with cables (12) to the ratchet wheel (24) which is symmetrically opposite another ratchet wheel (5). The ratchet pawl (7), currently in the hold position, acts as a retainer to block the ratchet wheel (5) in the downward position. The ratchet pawls (7) are connected by cable (6) to the untying pedal (20).

FIG. 7 The symmetrical side winches (30-31) are composed of casings (4-23) in which fit the ratchet wheels (5-24), ratchet pawl (7), spring (8), cover (9-25) and screw (10). The ratcheted wheel (5-24) acts as a winch to wind the cables (12). The inside part of the cables (12) are connected through crimped sleeves (14) that link the link plate (3), which is preferably made of rigid material, to the inner sole (2). When the weight of the user is applied on the inner sole (2), it creates tension in cables (12) which allows the ratchet wheels (5-24) to turn. When turning, the ratchet wheels (5-24) act as a winch to wind the outside part of cables (12). The straps (15) are connected to cables (12) by hangers (11). When turning sufficiently, the ratchet wheels (5-24) interfere with ratchet pawls (7) to block rotation and thus tying the shoe. Untying cables (6) with crimp sleeves (22) are connected between upper pedal (20) and lower pedal (19) which are assembled with screw (32). The spring (8) maintains force on ratchets pawls (7) to ensure tying state. When the user pulls on pedal (19-20), it pulls on ratchet pawls (7) to allow the ratchet wheel (5-24) to turn freely, thus untying the shoe. The symmetrical side tracks (16-26) reduce side pressure and friction. The straps (15) passing through buckles (18) allow the user to adjust tension. A holding rod (17) acts as a guide and keeps the tongue open by creating reacting force in downward position.

The invention claimed is:

1. A weight-activated tying footwear comprising:

a sole being operable between a first raised configuration and a second depressed configuration, a tongue for tightening and loosening the footwear against a foot of a user, and a body;

at least two side winches, each side winch being oppositely housed in a corresponding vertical side wall of the body and connectable to the tongue and the sole by at least one tension element, the at least two side winches being operable between the raised configuration and the depressed configuration, wherein in the raised configuration, the sole is in a raised position with respect to the ground, the tongue is angled away from the ground, and the foot of the user is extractable and insertable into the footwear, and wherein in the depressed configuration, the sole is pressed down upon insertion of the foot of the user and the sole pulls the at least one tension element, tightening the tongue against the inserted foot of the user; and wherein each side winch comprises:

a rotatable ratchet wheel for winding the at least one tension element around the ratchet wheel upon insertion of the foot of the user thus pushing the sole towards the ground, thus tensioning the at least one tension element and rotating the ratchet wheel, and for unwinding the at least one tension element around the ratchet wheel upon removal of the foot of the user from the footwear;

a ratchet pawl for removably engaging the ratchet wheel, the ratchet pawl being operable between the raised configuration wherein the ratchet pawl is disengaged from the ratchet wheel allowing it to freely rotate, and the depressed configuration, wherein the ratchet pawl engages the ratchet wheel preventing its rotation;

a biasing element applying force against the ratchet pawl so as to maintain removable engagement of the ratchet pawl with the ratchet wheel in the depressed configuration; and a casing integrating the ratchet wheel, the ratchet pawl, and the biasing element.

2. The weight-activated tying footwear according to claim 1, wherein the at least one tension element is an attachment selected from the group consisting of cables, strings, chords, and straps.

3. The weight-activated tying footwear according to claim 1, wherein the sole is made of a flexible material.

4. The weight-activated tying footwear according to claim 3, wherein the sole is connectable to each side winch by a link plate.

5. The weight-activated tying footwear according to claim 1, wherein the tongue comprises at least one tightening device selected from the group of tension adjusters consisting of a strap, a tie, a belt, a lace, a string, a wire, a cable, and a hook-and-loop fastener, the at least one tightening device being connectable to an end of the at least one tension element for tightening the tongue against the foot of the user.

6. The weight-activated tying footwear according to claim 1, further comprising an untying pedal mounted on the rear of the body and connectable to each side winch by a connector, the untying pedal permitting the user to loosen the tongue against the inserted foot of the user by manipulating each side winch so as to unwind the at least one tension element around the ratchet wheel.

7. The weight-activated tying footwear according to claim 6, wherein the connector is an attachment selected from the group consisting of cables, strings, chords, and straps.

* * * * *